United States Patent [19]

Cowden et al.

[11] 4,272,934

[45] Jun. 16, 1981

[54] PANEL STRUCTURE FOR BLOCKING WINDOWS

[75] Inventors: Ernest A. Cowden, Kansas City; Leo E. Lauber, Eudora, both of Kans.

[73] Assignee: The Clear Corporation, Eudora, Kans.

[21] Appl. No.: 6,686

[22] Filed: Jan. 26, 1979

Related U.S. Application Data

[63] Continuation-in-part of Ser. No. 846,416, Oct. 28, 1977, abandoned.

[51] Int. Cl.[3] ..... E06B 3/28

[52] U.S. Cl. ..... 52/202; 49/61; 52/309.9

[58] Field of Search ..... 52/202, 71; 428/12, 428/57; 160/113; 49/59, 60, 61, 62

[56] References Cited

U.S. PATENT DOCUMENTS

| | | | |
|---|---|---|---|
| 2,449,264 | 9/1948 | Wilkinson | 49/62 |
| 3,214,879 | 11/1965 | Ellingson | 52/202 |
| 3,832,263 | 8/1974 | Cleveland | 428/12 |
| 4,057,936 | 11/1977 | Wyatt | 52/731 |
| 4,068,428 | 1/1978 | Peterson | 52/202 |
| 4,079,558 | 3/1978 | Gorham | 52/202 |

*Primary Examiner*—John E. Murtagh
*Attorney, Agent, or Firm*—Lowe, Kokjer, Kircher, Wharton & Bowman

[57] ABSTRACT

A panel structure for use in blocking glass panes against the passage of heat and cold. In one form the structure comprises first and second rigid foam panel sections joined together by a flexible sheet. The ends of the panels are exposed underneath the sheet so that they may be trimmed to fit the glass pane. Releasable means is also provided for mounting the panel sections in blocking relationship to the glass pane.

In another embodiment one of the rigid foam panel sections is provided with a tapered edge so that the section will fit behind the lock on a double hung window. In a further embodiment of the invention a plurality of u-shaped channels are placed around the periphery of the rigid foam sections to form framework. Releasable means may then be secured to the framework to hold the panel structure in blocking relationship to the glass pane. A still further embodiment encompasses use of a frame of rigid foam insulation which framework is placed around the glass pane and the releasable mounting means is secured thereto.

4 Claims, 10 Drawing Figures

PANEL STRUCTURE FOR BLOCKING WINDOWS

This is a continuation-in-part of application Ser. No. 846,416, filed Oct. 28, 1977, now abandoned.

This invention relates generally to insulating devices and more particularly to a panel structure of rigid foam which may be used to block off glass panes for insulating purposes.

With the advent of fuel shortages and the resultant emphasis on conserving energy, it has become increasingly important to control the temperature of buildings in an efficient manner. In the summer, the sunlight which passes through window panes acts to heat the interior of buildings to a significant extent, thereby adding substantially to the cooling load. Moreover, window glass provides poor thermal insulation so that heat is readily able to leak into the room in summer and out in winter. Although it is common to provide curtains or shutters that may be closed across the inside of the window, sunlight is nevertheless able to pass through the windown pane and into the interior of the room where its heating effect is nearly as great as in the absence of curtains or shutters.

The present invention is directed primarily at eliminating these problems and has as its principal goal the provision of a panel structure which may be used to block off window panes.

More specifically, it is an object of the invention to provide a panel structure which may be quickly and easily mounted against a window in position to prevent sunlight from passing therethrough.

Another object of the invention is to provide a panel structure of the character described which is constructed in a manner enabling it to block all or only a selected portion of a window pane. To accomplish this, the panel is arranged such that it can be folded in half to thereby expose half of the window glass.

A further object of the invention is to provide a panel structure of the character described which is constructed of a rigid foam substance having good thermal insulating properties in order to decrease the leakage of heat through the window area.

It is also an aim of the present invention to provide a panel structure as described in the foregoing objects which may be readily trimmed to the exact size of a particular glass pane.

It is also an objective of the present invention to provide a panel structure for insulating a glass pane which will fit behind a lock which partially extends into the area of glass pane.

Still another one of the objects of the invention is to provide a panel structure of rigid foam for blocking a glass pane which incorporates a u-shaped channel member disposed around the periphery of the panel to give it a finished appearance particularly after trimming the panel to size.

It is another one of the objects of the invention to provide a panel structure as described in the foregoing objects and also a rigid thermally insulating framework which may be used to mount the panel structure in blocking relationship to a window.

An additional object of the invention is to provide a panel structure of the character described which is light in weight so as to be easily handled, which is constructed simply and economically, and which possesses substantial strength and durability.

Other and further objects of the invention, together with the features of novelty appurtenant thereto, will appear in the course of the following description.

In the accompanying drawing which forms a part of the specification and is to be read in conjunction therewith and in which like reference numerals are used to indicate like parts in the various views.

Figure 1:
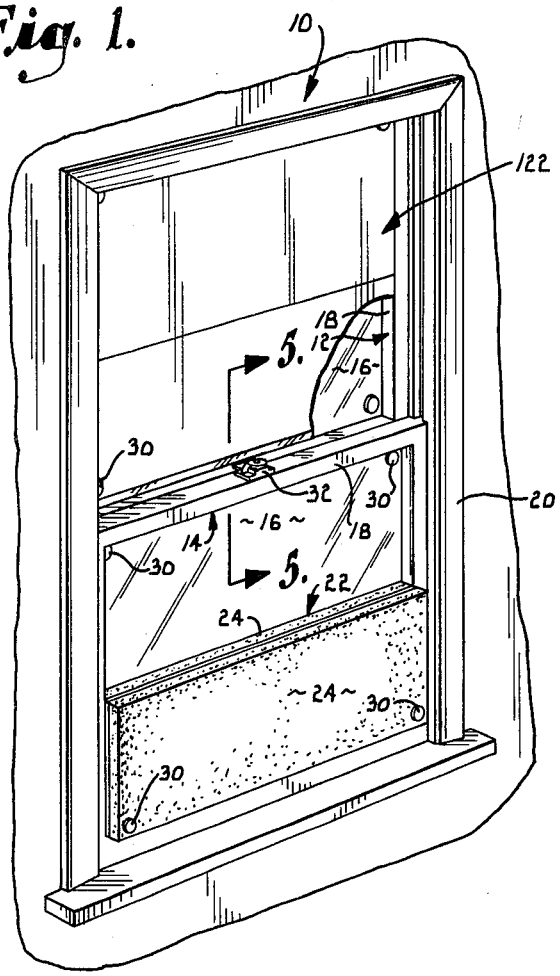
FIG. 1 is a perspective view illustrating a pair of foam panels constructed according to the present invention mounted in upper and lower window panes with a portion of the upper panel broken away for purposes of illustration and with the lower panel shown in its folded position.

Referring initially to FIG. 1 a double hung window is designated generally by the numeral 10. Window 10 comprises upper and lower sections designated generally by the numerals 12 and 14. Each section comprises a glass pane 16 which is mounted in a framework 18. The two sections 12 and 14 are mounted in a casing 20.

Figure 2:
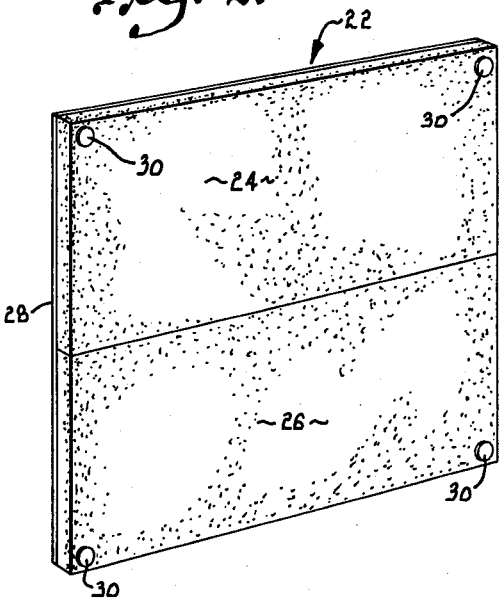
FIG. 2 is a side elevational view showing one of the panel structures of FIG. 1 in its unfolded position from the side of the window opposite the side shown in FIG. 1.
Figure 3:
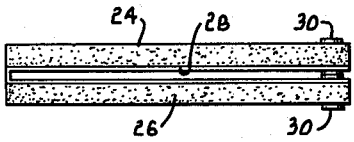
FIG. 3 is an end elevational view showing one of the panel structures in folded position.

One form of panel structure according to the present invention is shown in FIG. 2 and designated generally by the numeral 22. Panel structure 22 comprises two rigid foam panel sections 24 and 26 each presenting two relatively flat planar surfaces. The two sections are joined together by a thin sheet of flexible material 28 preferably plastic. The sheet of material 28 is adhesively secured to one side of sections 24 and 26 thus forming a hinged coupling for the two sections.

Magnets 30 are secured to sections 24 and 26 and are disposed in alignment with other magnets 32 which are mounted on glass pane 16 of lower window section 14.

It is to be noted that the ends of panel sections 24 and 26 are exposed beneath material 28 so as to readily accomodate trimming of the sections to fit a particular size window pane. This is a significant factor in reducing manufacturing costs by allowing a relatively small number of sizes to be made and then trimmed by the ultimate user.

When the panel structure 22 is to be used it is trimmed to fit pane 16 and magnets 30 are secured to the pane by an appropriate adhesive. Structure 22 is then placed in blocking relationship to the pane 16 and is held in place by the magnets. When the structure is to be used to block the window pane it is placed in its unfolded position wherein material 28 presents a substantially continuous flat surface parallel to the plane of pane 16. If it is desired to partially unblock window pane 16 to allow for the passage of light upper section 24 is folded down against lower section 26 in the manner illustrated in FIG. 1. This, of course, is possible as a result of the hinged coupling formed by the flexible material 28. It is to be noted that the adjacent edges of sections 26 and 28 are exposed beneath sheet 28 so that when the sections are in their unfolded position the edges are in abutting relationship to present a substantially continuous sheet of rigid foam insulation.

An alternative form of panel structure according to the present invention is illustrated in FIG. 1 and is designated generally by the numeral 122. Structure 122 is identical to panel structure 22 previously described except that the lower insulating section 26 is modified to accomodate a sash lock 32 which secures upper and lower window sections 12 and 14.

Figure 5:
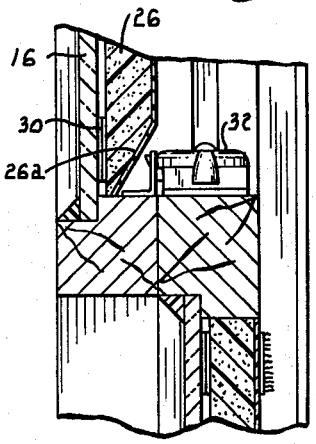
FIG. 5 is a vertical cross-sectional view taken along line 5—5 of FIG. 1.

Referring to FIG. 5, lower insulating section 26 is provided with a tapered lower edge 26*a* of a size that will allow section 26 to be placed behind sash lock 32. Thus the entire glass pane 16 is covered notwithstanding the presence of the lock.

Figure 4:
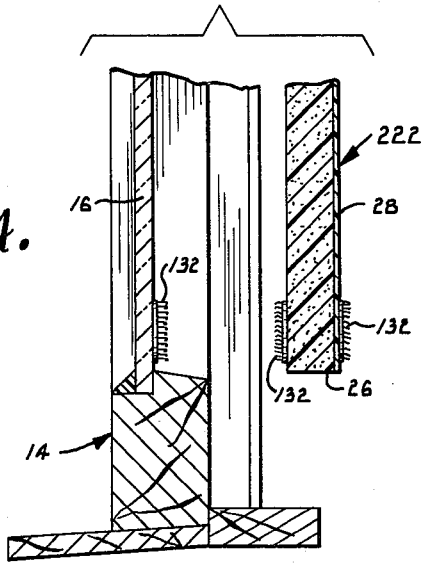
FIG. 4 is a fragmentary vertical cross-sectional view illustrating an alternative manner in which a panel structure may be secured to a glass pane.

Still another alternative form of panel structure is illustrated in FIG. 4 and designated generally by the numeral 222. Structure 222 is identical to panel structure 22 previously described except that magnets 30 are replaced with complementary fasteners of the type comprising interlocking "stiches" of synthetic fabric such as is commonly sold under the trademark VELCRO.

Figure 6:
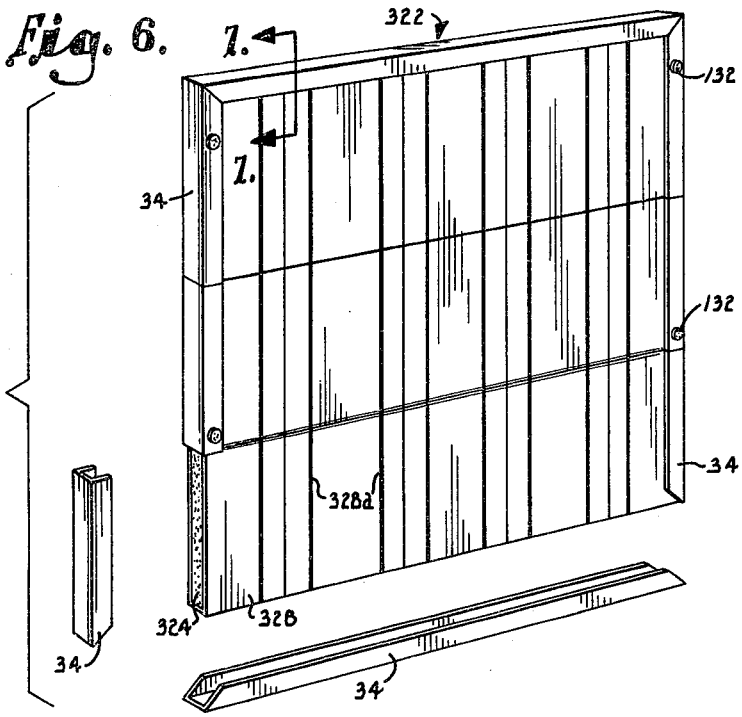
FIG. 6 is a perspective partially exploded view of an alternative form of panel structure according to the present invention.
Figure 7:
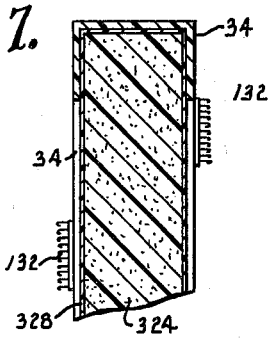
FIG. 7 is a vertical cross-sectional view taken along line 7—7 of FIG. 6.
Figure 8:
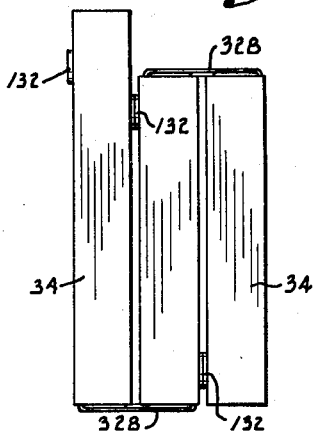
FIG. 8 is an end elevational view showing the panel structure of FIG. 6 in its folded position.

Referring now to FIG. 6, a further embodiment of the invention is shown and is designated generally by the numeral 322. Panel structure 322 is comprised of a plurality of rigid foam panel sections 324 which are covered by a sheet of flexible material 328 that is embossed, printed or otherwise decorated to present a plurality of vertical lines 328*a* for forming a decorative pattern. Panel sections 324 are provided with u-shaped channel members 34 around the outer edges to form a framework for the panel structure. Each channel member 34 is formed from a resilient material having a cross-sectional dimension at its smallest point which is slightly smaller than the thickness of the panel sections 324 plus the outer covering 328. Thus it is necessary to slightly spread the legs of channel members 34 in order to place them on the panel sections. The inherent memory of each of the channel members cause it to tightly grasp a panel section once it is in place. Each section 324 is provided with Velcro-type fasteners 132 along the edges of channel members 34. Corresponding fasteners may be secured to the glass pane which is to be covered. When structure 322 is not to be used it may be moved to the folded position illustrated in FIG. 8 and to this end additional fasteners 132 are provided on the inside of channel members 34.

Figure 9:
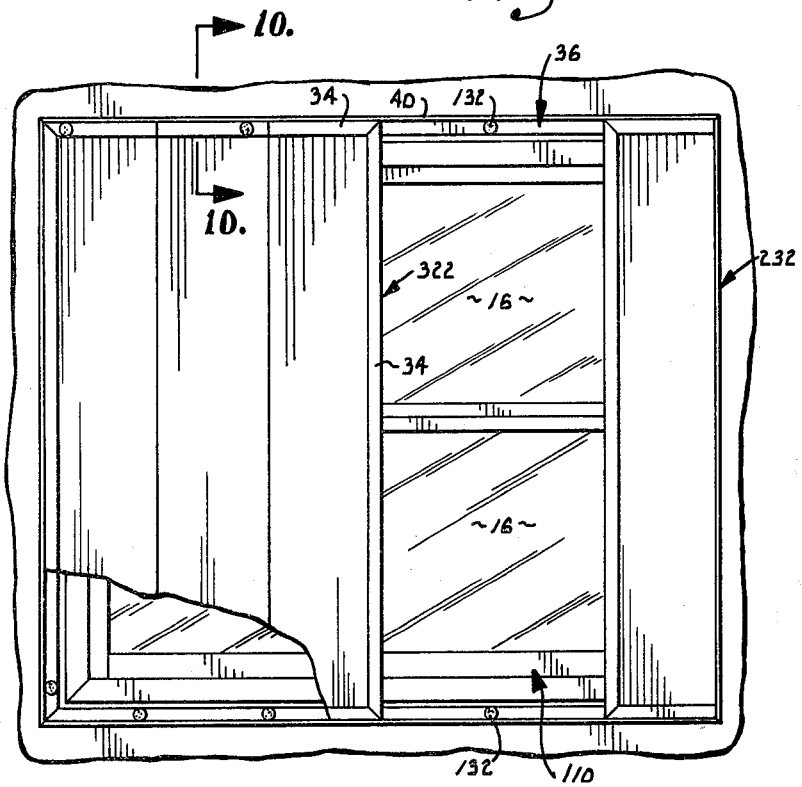
FIG. 9 is a side elevational view with portions partially broken away of an alternative form of panel structure wherein a mounting framework is employed.
Figure 10:
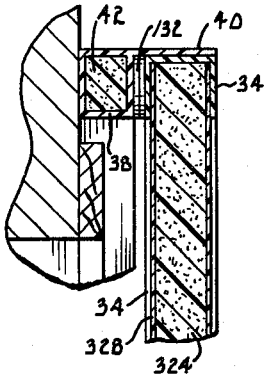
FIG. 10 is a vertical cross-sectional view taken along line 10—10 of FIG. 9 and illustrating details of the mounting framework.

Another embodiment of the invention is illustrated in FIG. 9. In this embodiment two panel structures 322 are disposed with their hinge points in a vertical plane and mounted in blocking relationship to glass panes 16 by an insulated framework designated generally by the numeral 36. One structure 322 is illustrated in folded position and the other unfolded. Details of framework 36 are best illustrated in FIG. 10. A hollow tubular member 38 has an integral lip extension 40 along one side. The tubular member is also filled with a rigid insulating foam 42. Appropriate fasteners such as Velcro type fasteners 132 are spaced along one side of tubular member 38. Corresponding fasteners are secured to panel structure 232.

Tubular members 38 are disposed around the periphery of window 110 to form a framework for mounting the panel structures. It will be appreciated that upon installation channel members 34 will abut lip extensions 40. Lip extensions 40 thus serve as a casement for the panel structures and also increase the aesthetics after installation. In this manner a relatively large dead air space is provided between panes 16 and the panel structures thus enhancing the insulating properties.

While the invention has been particularly described with reference to releasable fasteners such as magnets and Velcro type fasteners it is to be understood that still other devices may be employed to mount the panel structures relative to a glass pane. For example, hooks secured to opposite ends of an elastic strip and designed to be fastened to complementary fasteners on the window frame make an acceptable device for securing the panel structures in blocking relationship to a window pane.

The light weight of each of the panel structures permits it to be easily handled when installing it or removing it from a glass pane and also when moving it from its unfolded window blocking position to its folded position whereby some of the glass pane is uncovered. The invention will find industrial application wherever glass panes are used in building construction. This includes, but is not limited to, homes, offices, shops, schools and businesses.

The material used to cover the rigid foam sections may be any type of flexible covering which will withstand repeated folding and unfolding. The particular material used will depend in large part on the decorative effect desired when the panel structure is in place.

We claim:

1. A panel structure for blocking a glass pane, said panel structure comprising:

a rigid framework of thermally insulating material, said framework extending on all sides of said glass pane;

a plurality of panel sections each constructed of a rigid thermally insulating material adapted to substantially prevent the passage of light therethrough, said panel sections having adjacent edges and each presenting opposed substantially flat surfaces, the ends of said panel sections being exposed under said sheet whereby said sections may be trimmed to a desired size;

a flexible sheet coupled with both panel sections along two aligned flat surfaces to hingedly couple said sections together, the adjacent edges of said sections being exposed beneath said sheet whereby when said flat surfaces are aligned said edges are is abutting relationship, said sheet being foldable to provide a hinge axis about which said sections may be moved to a folded position; and means for coupling said panel sections with said framework to thereby hold said sections in a pane blocking position.

2. The invention of claim 1, wherein said framework comprises a rigid foam insulating material.

3. The invention of claim 2, wherein said framework presents a lip extension projecting therefrom in overlapping relationship to said panel sections when the latter are in their pane blocking position.

4. The invention of claim 3, wherein is included a plurality of U-channel members disposed around the outer edges of said sections to form a framework encasing said sections, each of said channel members having resilient sides for grasping said sections and being removable from said sections.

* * * * *